United States Patent [19]

Ivins

[11] 4,093,181

[45] June 6, 1978

[54] POWERED VEHICLE JACK

[76] Inventor: Raymond W. Ivins, 1901 SE. Minter Bridge Rd., #69, Hillsboro, Oreg. 97123

[21] Appl. No.: 795,393

[22] Filed: May 9, 1977

[51] Int. Cl.[2] ..... B66F 3/02

[52] U.S. Cl. ..... 254/97

[58] Field of Search ..... 254/95–97, 254/86 R, DIG. 2, 103, 108

[56] References Cited

U.S. PATENT DOCUMENTS

| | | | |
|---|---|---|---|
| 1,763,144 | 6/1930 | Fuller | 254/DIG. 2 |
| 3,768,778 | 10/1973 | Arnes | 254/2 B |
| 3,788,604 | 1/1974 | Cameron | 254/108 |

FOREIGN PATENT DOCUMENTS

| | | | |
|---|---|---|---|
| 640,855 | 5/1962 | Canada | 254/DIG. 2 |
| 31,437 | 5/1961 | Finland | 254/95 |

*Primary Examiner*—Robert C. Watson

*Attorney, Agent, or Firm*—James D. Givnan, Jr.

[57] ABSTRACT

An automotive jack having a motorized carriage on which is carried a rotatable member engageable with a series of recesses located along a jack standard. The carriage is roller mounted on the jack standard and includes a bumper engaging arm. A reversible motor drives the rotatable member through a gear reduction, worm drive which restricts carriage movement to only motor powered movement. A latch also prevents accidental carriage slippage. A motor power source is disclosed as the vehicle electrical system.

5 Claims, 4 Drawing Figures

POWERED VEHICLE JACK

BACKGROUND OF THE INVENTION

The present invention concerns automotive jacks of the type for use by the car operator during roadside emergencies. Additionally, the present invention pertains to that class of jacks including a prime mover carried by and imparting movement to a jack carriage.

Typically, automotive jacks of the type for emergency use, are manually actuated. The task of jacking up an automobile, as in the changing of a flat tire, presents an arduous task for certain members of the motoring public. Further, the operation of an automobile jack presents some risk in that the jack must be operated with care and some understanding of its operation. Admittedly, the general concept of a motorized jack for emergency use is known in the prior art, as for example in U.S. Pat. Nos. 3,062,504; 3,244,401; 3,314,656; 3,392,959; 3,606,252 and 3,844,535.

SUMMARY OF THE PRESENT INVENTION

The present invention is embodied with a jack having a motorized carriage for travel along a stationary jack standard with said carriage including a cog type drive.

The motorized carriage of the present jack is roller mounted on the jack standard and carries a motor in driving engagement, via a reduction drive, with a carriage mounted cogwheel, the latter being engageable with a series of apertures along the jack standard. A worm gear drive imparts rotary motion to the cogwheel for movement of the carriage along said standard. A swingably mounted bumper bracket is carried by the carriage to engage the vehicle bumper assembly. The carriage mounted motor is of the reversible type to power the carriage during both lifting and lowering carriage movement. A safety lock successively engages the standard apertures during upward movement of the carriage to mechanically lock the carriage against undesired downward movement. The worm gear drive serves to provide a secondary lock to prevent inadvertent carriage movement.

Important objectives of the present jack include the provision of a motorized jack of compact, low cost construction rendering same suitable as a replacement for existing manually operated jacks; the provision of a jack of uncomplicated design and safe operation even for those not mechanically inclined; the provision of a motorized jack utilizing a cogwheel drive for positive carriage-standard engagement; the provision of a jack having motorized carriage including a worm gear drive to provide a desired gear reduction and which functions as a secondary safety lock to prevent inadvertent movement of the carriage along the jack standard; and; the provision of a jack having a carriage on which the jack motor is mounted.

DETAILED DESCRIPTION OF THE PREFERRED EMBODIMENTS

Figure 1:
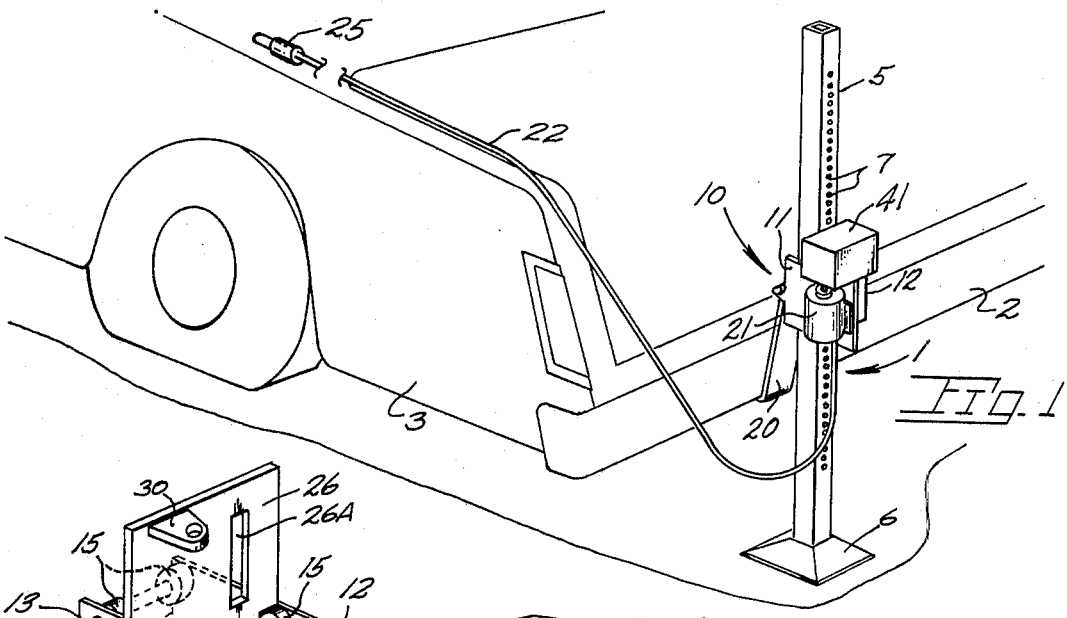
FIG. 1 is a perspective view of the rear quarter of an automobile with the present jack in place during a jacking operation.
Figure 4:
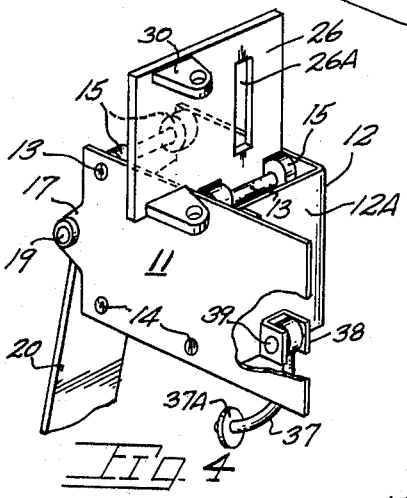
FIG. 4 is a perspective view, on a reduced scale, of the jack carriage with certain carriage components removed for purposes of illustration.
Figure 2:
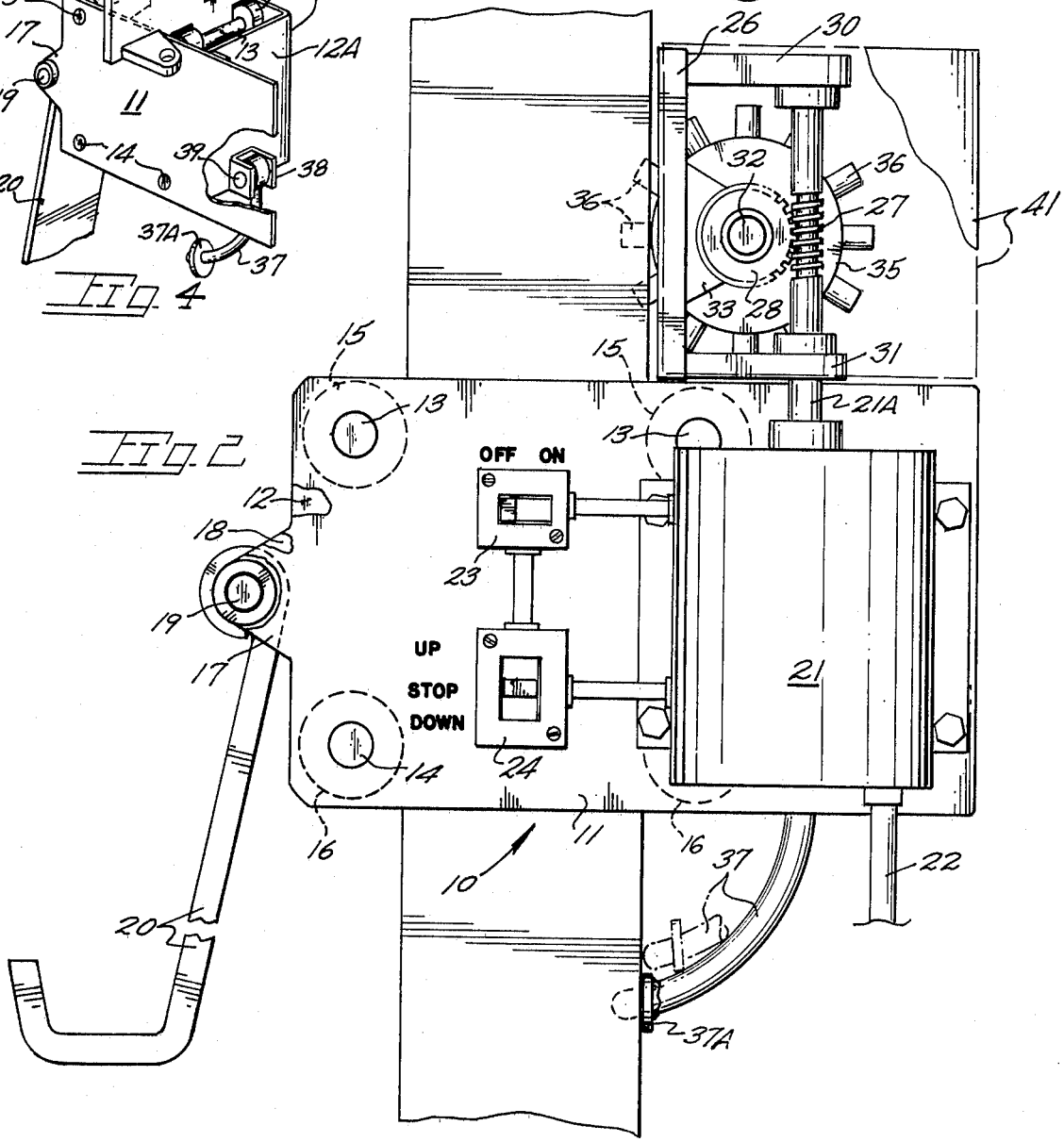
FIG. 2 is a fragmentary, side elevational view of the carriage of the present jack.

With continuing reference to the accompanying drawings wherein applied reference numerals indicate parts similarly identified in the following specification, the reference numeral 1 indicates generally the present jack in operative disposition adjacent a bumper assembly 2 of a vehicle at 3.

The present jack includes a jack standard 5, the lower end of which is engageable with a base 6. A series of recesses 7 extend lengthwise in a spaced manner along said standard and receive a later described rotatable component of a jack carriage.

The jack carriage is indicated generally at 10 and comprises a frame weldment having sidewall components 11 and 12 rigidly interconnected by pairs of upper and lower roller equipped spacers 13 and 14. Pairs of upper and lower rollers at 15 and 16 are suitably journalled on said spacers and are thereby confined against lateral movement thereon. Carriage wall 12 is of angular shape having a right angular portion 12A which is flanged at 12B for securement to sidewall 11 as by spot welding.

Said frame sidewalls are provided, at their corresponding ends, with wall projections at 17 and 18 which serve to carry, in a reinforced manner, a pin 19 which in turn carries a bumper engaging bracket 20 in a swingable manner. The configuration of bracket 20 will obviously be subject to change to accommodate different bumper designs.

Sidewall 11 of the carriage is of somewhat greater length than remaining sidewall 12 and thereat provides a mounting pad for a low voltage, electric motor 21 which is of the reversible type and may include internal speed reduction components. A motor control circuit is in circuit with a power source, represented by a power cord 22, said circuit including a power switch 23 and a motor field reversing switch 24. Reversing switch 24 is preferably of the three position type having a center "open" position for purposes of jack safety. Power cord 22 is fitted at its free end with a plug 25 (FIG. 1) for insertion into the cigarette lighter socket of the vehicle.

Figure 3:
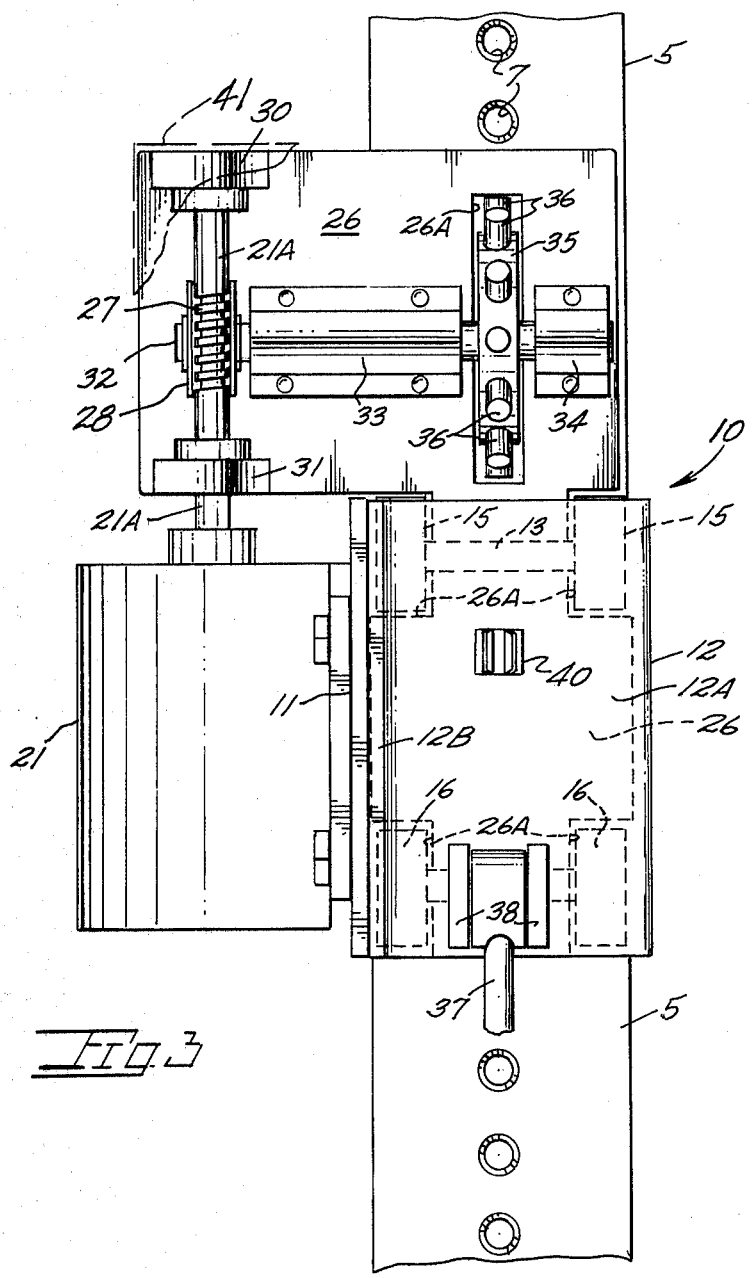
FIG. 3 is an elevational view taken from the right-hand side of FIG. 2.

The motorized carriage additionally includes an upright plate member 26, welded intermediate the carriage sidewalls and which serves to mount gear components and a rotatable member driven thereby. An output shaft 21A of motor 21 powers a worm 27 enmeshed with a worm gear 28. Bearing supports 30-31 journal shaft 21A while worm gear 28 is carried by a shaft 32 suitably journalled within sleeve bearings 33 and 34 on plate member 26. Said rotatable member is disclosed as a cogwheel at 35 with cogs 36 engageable with the jack standard recesses as it rotates within opening 26A in plate 26. Said recesses may be somewhat flared to assure cog registration. The carriage rollers in conjunction with close tolerances between carriage sidewalls and jack standard surfaces assures cog-recess alignment. Plate member 26 has cut out areas 26A (FIG. 3) to receive upper and lower pairs of rollers 15 and 16.

A latch at 37 swingably depends from a carriage mounted clevis at 38 which carries a pivot pin 39. The latch is configured at its distal end to swingably engage successive jack standard recesses 7 as the carriage moves upwardly therealong. Downward carriage movement is permitted by upward repositioning the latch within a holder 40 on the carriage. Latch 37 engages the recesses 7 to the extent permitted by a stop 37A on the latch end.

For purposes of safety, the worm gear drive and cogwheel are housed within a cover 41 secured in place by fasteners preferably of the type discouraging tampering.

In operation, motor 21 drives cogwheel 35 to raise or lower the carriage and the bumper bracket carried thereby. The worm gear drive provided provides a gear reduction drive of a high ratio to enable the use of a motor 21 of convenient size. Additionally the worm gear drive serves to lock the cogwheel against rotation when the motor is inoperative.

While I have shown but one embodiment of the invention it will be apparent to those skilled in the art that the invention may be embodied still otherwise without departing from the spirit and scope of the invention claimed.

Having thus described the invention what is desired to be secured under a Letters Patent is:

1. An automotive jack comprising in combination, a jack standard supported in a stationary manner by a ground engaging base and having recesses spaced therealong, and a carriage for powered travel along said standard and including, a roller equipped frame for rolling travel along said standard, a bumper engaging arm mounted on said frame, rotatable means on said frame engageable with said standard recesses, a gear reduction drive coupled to said rotatable means, a motor mounted on said frame and coupled to said reduction drive, and switch means in circuit with said motor and with a power source to control carriage movement along said jack standard.

2. The automotive jack claimed in claim 1 additionally including plug means in circuit with said switch means and connectable with a vehicle electrical system.

3. The automotive jack claimed in claim 1 wherein said rotatable means is a cogwheel and said jack standard recesses are cog receiving openings.

4. The automotive jack claimed in claim 1 wherein said gear reduction drive includes a worm and worm gear inoperative in the absence of motor operation to prevent inadvertent carriage movement.

5. The automotive jack claimed in claim 1 additionally including a latch swingably mounted on said carriage both gravitationaly and successively engageable with jack standard recesses to prevent downward movement of said carriage.

* * * * *